United States Patent [19]

Steffen

[11] 4,045,878

[45] Sept. 6, 1977

[54] VENTILATION PROCESS FOR INDUCING BIOCHEMICAL REACTIONS IN STORED FOOD GRAIN WHILE PRESERVING DORMANCY

[76] Inventor: Sylvester L. Steffen, R.R. 3, New Hampton, Iowa 50659

[21] Appl. No.: 642,577

[22] Filed: Dec. 19, 1975

[51] Int. Cl.[2] ..... E04H 7/00

[52] U.S. Cl. ..... 34/26; 34/20; 34/30; 98/55

[58] Field of Search ..... 98/55, 52, 53, 54, 56, 98/57; 34/26, 30, 20, 22, 233

[56] References Cited

U.S. PATENT DOCUMENTS

| | | | |
|---|---|---|---|
| 2,782,705 | 2/1957 | Breidery | 98/55 |
| 3,264,118 | 8/1966 | Kilcrease et al. | 34/26 X |
| 3,563,460 | 2/1971 | Nine | 98/55 X |

FOREIGN PATENT DOCUMENTS

| | | | |
|---|---|---|---|
| 433,966 | 5/1925 | Germany | 98/55 |

OTHER PUBLICATIONS

Stivers, Jr., et al., *Official Gazette*, "Method of Preventing Deterioration of Grain in Storage", June 19, 1951, vol. 647, pp. 985–986.

*Primary Examiner*—William F. O'Dea
*Assistant Examiner*—Harold Joyce
*Attorney, Agent, or Firm*—Henderson, Strom and Sturm

[57] ABSTRACT

A process for storing and preserving grain once it has been cured by promoting hydrolysis of the grain starches and proteins to thereby alter the grain composition to a more usable state and to effect and increase in the dry weight of the grain.

3 Claims, 9 Drawing Figures

VENTILATION PROCESS FOR INDUCING BIOCHEMICAL REACTIONS IN STORED FOOD GRAIN WHILE PRESERVING DORMANCY

BACKGROUND OF THE INVENTION

The present invention relates generally to the control of the storage environment for bulk-stored food grains, and more particularly to controlling the storage environment in such manner that hydrolysis of the grain starches and proteins is promoted while, at the same time, respiration within the stored grain is inhibited.

In the field of bulk storage of grain it is generally assumed that grain moistures above a certain arbitrarily fixed level cannot be tolerated. In storage of corn, for instance, the accepted method of storage is to dry the grain to 13% moisture level as quickly as possible after harvest in the fall. Corn dried to this level is then considered to be "safe" from the forces causing deterioration and therefore it is assumed that the management and control of the grain environment is no longer necessary.

Grain Drying — Bringing Grain to Dormancy

The methods of grain drying heretofore employed have chosen to ignore or, at least, failed to recognize that grain is a living organism. Drying methods used are those applicable for use with non-living products. These methods, while consuming vast quantities of fuel energy, result in serious injury to the grain by stress-cracking of the kernel, denaturation of the protein system, volatilization of oils, carmelizing of carbohydrates, and promotion of respiration within the grain. Respiration is a process wherein the grain sugars are consumed giving off carbon dioxide, heat, and water. These conditions cause a loss of grain weight and consequently a loss of grain value.

It is for these reasons that a "cool-drying" grain conditioning process has been developed wherein the temperatures of the grain during the drying process remains below that of the ambient air temperature. This process is discussed in co-pending Steffen U.S. patent application Ser. No. 422,760. This process deals with the drying of grain from the grain moisture level at time of harvest to the grain moisture level at which the grain is dormant or cured.

Grain Storage after Drying — Dormancy

Dormancy, or the cured state, is the state at which the grain temperature and moisture is in equilibrium with the current monthly average atmospheric air temperature and moisture. Dormancy for a given grain is thus a dynamic condition that will change from month to month. Dormancy is maintained at a higher grain moisture in the cooler months and a lower grain moisture in the warmer months, and at all times represents a condition of restricted respiration. The dynamic nature of dormancy is illustrated by the dormancy index as shown in FIG. 8 and FIG. 9.

Once the grain is brought to the dormant state, it is considered to be dried. If the grain moisture is reduced to a level below that at which it is dormant in a given month, then the grain is termed "overdried".

Those who recognize that grain is a living organism and that grain should be managed as such, also recognize that water is a necessary resource needed to insure continued vitality of the grain.

One of the most critical shortcomings in grain management is the failure to recognize the utility of water in the grain storage system. Water is generally assumed to be an evil that cannot be tolerated within the system. This assumption is erroneous. It is pervasive however, and it has resulted in the needless overdrying of grain. This overdrying has, in turn, resulted in a great expenditure of fuel. Further, it has resulted in a practice which inhibits the desirable process of hydrolysis of starches and proteins within the grain.

SUMMARY OF THE INVENTION

It is the teaching of this invention that hydrolysis of the grain starches and proteins can be promoted to alter the grain composition to a more usable state and effect an increase in the dry weight of the grain. The hydrolysis of starch and protein is generally represented as follows:

for starch:

$$C_{12}H_{22}O_{11} + H_2O \longrightarrow 2(C_6H_{12}O_6)$$

Starch + Water ⟶ Sugar for protein:

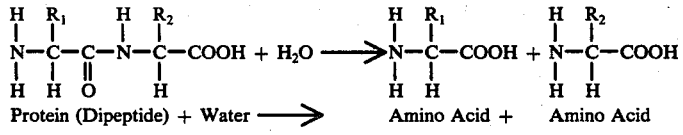

Protein (Dipeptide) + Water ⟶ Amino Acid + Amino Acid

Heretofore, conditions that promote increased hydrolysis are generally conditions which promote increased respiration as well, so that consumption of grain sugars result. Respiration is generally represented as follows:

$$C_6H_{12}O_6 + 6\,O_2 \longrightarrow 6\,CO_2 + 6\,H_2O + \text{Energy}$$

Sugar + Oxygen ⟶ Carbon Dioxide + Water + Heat

Hydrolysis has, therefore, been considered to be an undesirable development in stored grain because a net loss of grain weight results under these circumstances. Furthermore, conditions that generally promote increased respiration of the grain and attendant hydrolysis, are also conditions that favor proliferation of mold and bacteria. Thus, the gross deterioration associated with hydrolysis has been seen as generally adverse to grain, without appropriate casual relationships being made. No one has previously put hydrolysis in perspective apart from the undesirable effects of respiration and mold and bacteria infestation.

A tolerable grain moisture can be defined, given a certain grain temperature, so that as long as this temperature and moisture relationship exists, respiration will be restricted; and, given the relatively high moisture level with the grain at lower grain temperatures, conditions promoting hydrolysis will exist. This concept can be illustrated by reference to FIG. 8, which shows that a grain moisture above the dormancy index (Line B) represents a condition which promotes respiration, a grain moisture below the dormancy index (Line B) represents a condition which inhibits hydrolysis, and a grain moisture coinciding with the dormancy index (Line B) represents the optimum condition wherein respiration is restricted and hydrolysis is promoted.

Because of the density of grain, the grain is an excellent insultant and can retain its chilled condition. In fact, cold temperatures in grain may be retained even into the summer months except for the outermost several inches of grain exposed to the surface temperatures of the storage bin. Retaining the cold temperatures in the grain will allow higher grain moistures, which promotes hydrolysis, without stimulating respiration.

It is the object of this invention to promote hydrolysis of grain starches and protein while, at the same time, inhibiting respiration within the grain.

Another object of this invention is to utilize the insulative properties of grain to retain cold temperatures in the grain thereby allowing a higher grain moisture to exist which promotes hydrolysis without encouraging respiration without the grain.

A further object of this invention is to utilize wind-powered ventilation to evacuate heat and water of respiration from the exhaust plenum chamber of a grain bin when the ventilation means to the intake plenum is deactivated.

A still further object of the present invention is to maintain as high of a moisture level as is consistent with good grain conservation while maintaining as low of a grain temperature as is possible while using only energy resources available naturally from the surrounding air.

DESCRIPTION OF THE PREFERRED EMBODIMENTS

Figure 1:
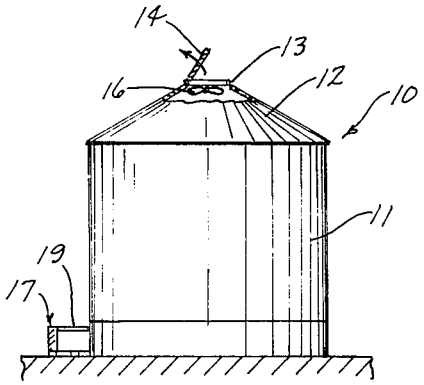
FIG. 1 is a side elevational view of a preferred embodiment for practicing the present invention.

Referring now to the drawings wherein like reference numerals designate indentical or corresponding parts throughout the several views, FIG. 1 shows a grain storage bin structure 10 which can be used in practicing the process of the present invention. The grain storage structure 10 of FIG. 1 is comprised of a conventional storage bin having sidewalls 11 and a roof 12. The roof 12 has an opening 13 in the top and center thereof and has a lid 14 which can selectively be used to open or close the opening 13. Disposed within the bin and immediate beneath the opening 13 is a fan 16 which is preferably electrically operated and is oriented and rotated so as to blow the air within the grain bin 10 out through the top opening 13. A damper mechanism 17 is connected to the bottom plenum chamber 18 through a tube 19 which is attached to the sidewall of the bin 11. This damper mechanism 17 will be explained more fully below in conjunction with the other embodiments and with respect to FIGS. 5–7. In operation, however, when the fan 16 is actuated and the damper 17 is open, air is circulated through the bin 10 and consequently through any grain which is disposed therein.

Figure 3:
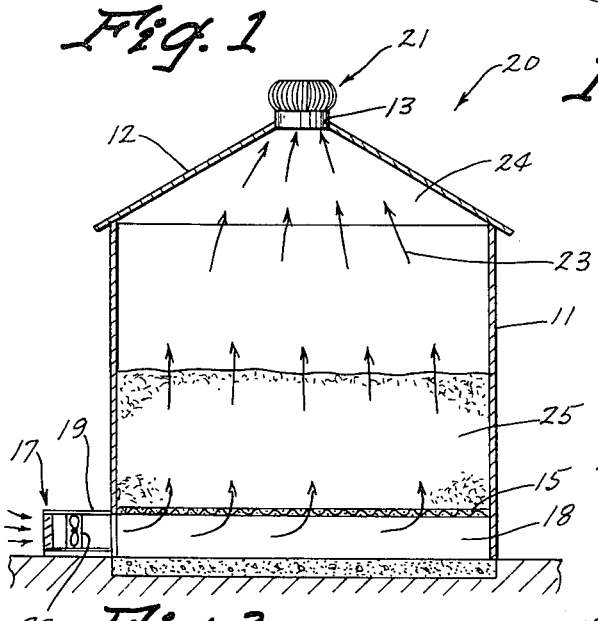
FIG. 3 is another preferred structure for use in practicing the present invention.

FIG. 3 shows another alternate structure which can be used in practicing the present invention. This structure is essentially identical to that shown in FIG. 1, except for several differences which will be apparent. The only thing directly associated with the opening 13 in the FIG. 3 embodiment 20 is a wind-powered ventilator and modulating device 21.

Figure 2:
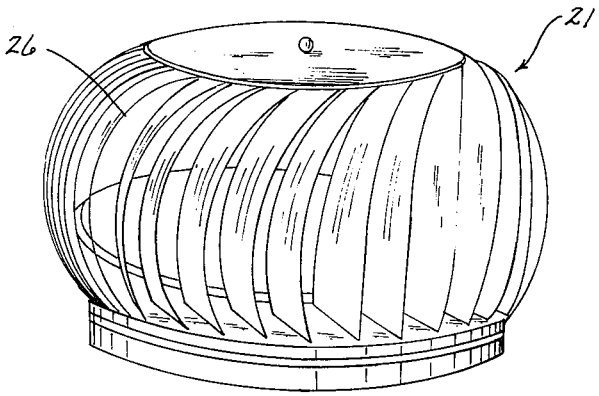
FIG. 2 is a perspective view of a turbine ventilator and air modulating device for use in certain embodiments of the present invention.
Figure 4:
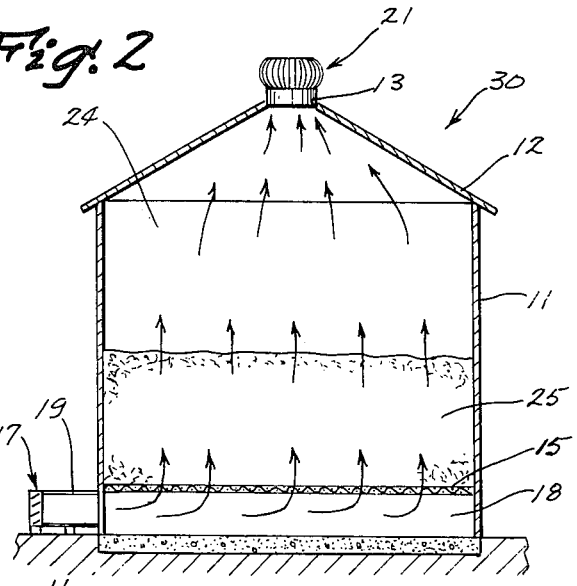
FIG. 4 is still another structure for use in practicing the present invention.

It is noted that the turbine ventilator 20 shown in FIGS. 2, 3, and 4 is essentially of the type shown in U.S. Pat. No. 3,041,956, although other types of wind-powered turbine ventilators are adequate for the purposes of this invention.

The tube 19 mounted to the bin wall 11 has a damper 17 such as the damper 17 shown in FIG. 1, but this tube 19 also has a fan 22 disposed therein which is preferably powered electrically to circulate air through the bin when the damper 17 is open as shown by the air circulation lines 23 which pass through the damper 17 and into the lower plenum chamber 18. This air then passes up through an air pervious floor 15, through the grain 25 to the exhaust plenum 24 and out through the openings 26 in the turbine ventilating device 21. When the damper 17 is closed such as is shown in FIG. 5, then the atmospheric winds are available to turn the turbine ventilator device 21 and draw air out from the top exhaust plenum chamber 24, but air is not drawn through the grain 25 when the damper 17 is closed.

FIG. 4 shows still another grain bin structure 30 which is adequate to perform certain aspects of the present invention. This structure 30 is virtually identical to the structure 20 shown in FIG. 3 except that the fan 22 in the tube 19 has been removed. In this structure, the turbine ventilator structure 21 is turned by the wind and this action will draw air through the grain 25 when the damper 17 is open as is shown in FIG. 6, and will exhaust and thereby remove moist and heated air from the top plenum chamber 24 when the damper 17 is closed; it being understood that when the damper 17 is closed that no air is able to enter the plenum chamber 18 and therefore no air can pass through the grain even though the turbine ventilating device 21 is being turned by atmospheric winds.

Figure 5:
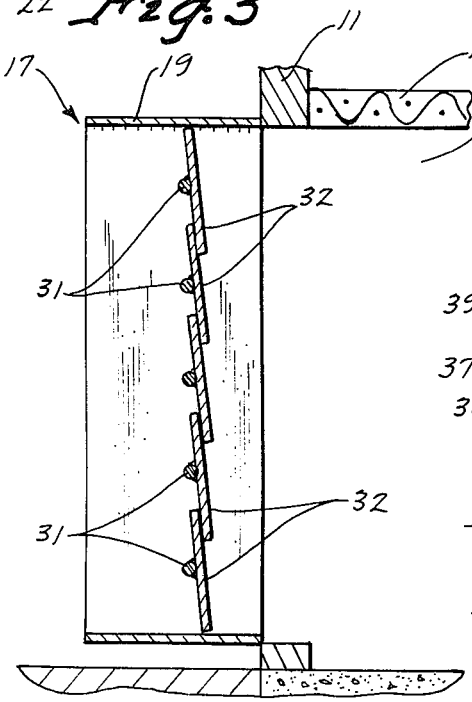
FIG. 5 is an enlarged cross-sectional view showing a damper mechanism for use in the present invention.
Figure 6:
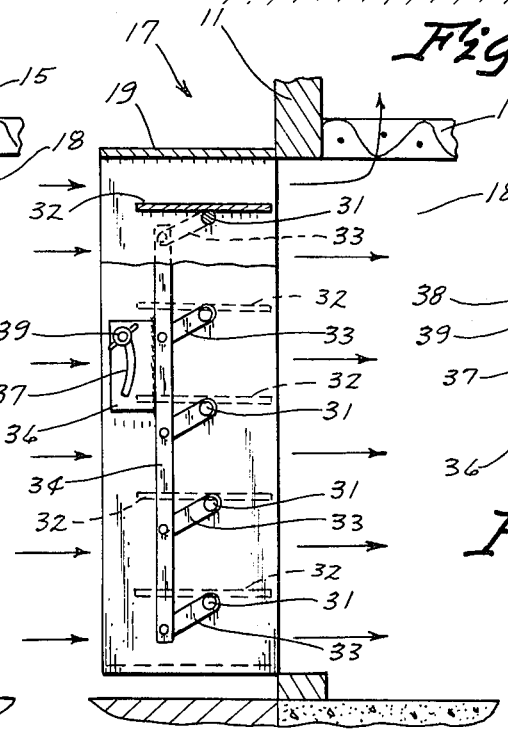
FIG. 6 is a partial cross-sectional view of the damper mechanism of FIG. 5.
Figure 7:
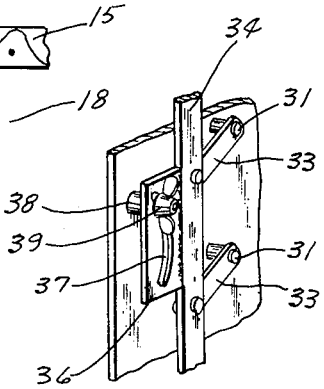
FIG. 7 is a partial perspective view of the locking and actuating mechanism of the damper mechanism shown in FIGS. 5 and 6.

Referring now to FIGS. 5–7, one example of a damper mechanism 17 is shown attached to the sidewalls 11 of a bin through a tube 19. FIG. 5 shows a plurality of rods 31 which extend from one side of the tube 19 to the other and are rotatably received at each end thereof in openings in the tube 19. A plate 32 is attached to each one of the rods 31, and these plates 32 are rotatably movable as the rods 31 are rotated. A lever 33 is rigidly attached to one end of each of the rods 31, and turning of the lever 33 causes a corresponding turning of the respective rod 31 and respective plate 32. A coupling bar 34 is pivotally attached to one end of each of the layers 33 as can be seen in FIGS. 6 and 7, and this coupling bar 34 has a plate 36 rigidly attached thereto.

The plate 36 has a groove 37 disposed therein through which is disposed a bolt-like projection 38 having a wing nut 39 threadedly engaging one end thereof. The projection 38 is of course fixed with respect to the tube 19.

It can be seen that in FIG. 6, the damper mechanism 17 is in the open position and allows air to pass from the atmosphere into the lower plenum chamber 18 so that the air can pass through the perforated floor 15 and then through the grain 25 and out the top opening of the bin 13. When it is desired to close the damper mechanism 17, the wing nut 39 is loosened and the coupling bar 34 is raised up so that the bolt 38 is disposed in the lower portion of the slot 37 in the plate 36. When this has been done, the damper mechanism 17 has been closed and moved from the opened position as shown in FIG. 6 to the closed position as shown in FIG. 5. The wing nut 39 is then tightened again in order to retain the damper 17 in the closed position. When it is desired to open the damper mechanism 17 again, a reverse procedure is followed whereby the wing nut 39 is again loosened, the coupling rod 34 lowered to the position shown in FIG. 6 and the wing nut 39 then tightened again so as to retain the damper mechanism 17 in the open position.

Figure 8:
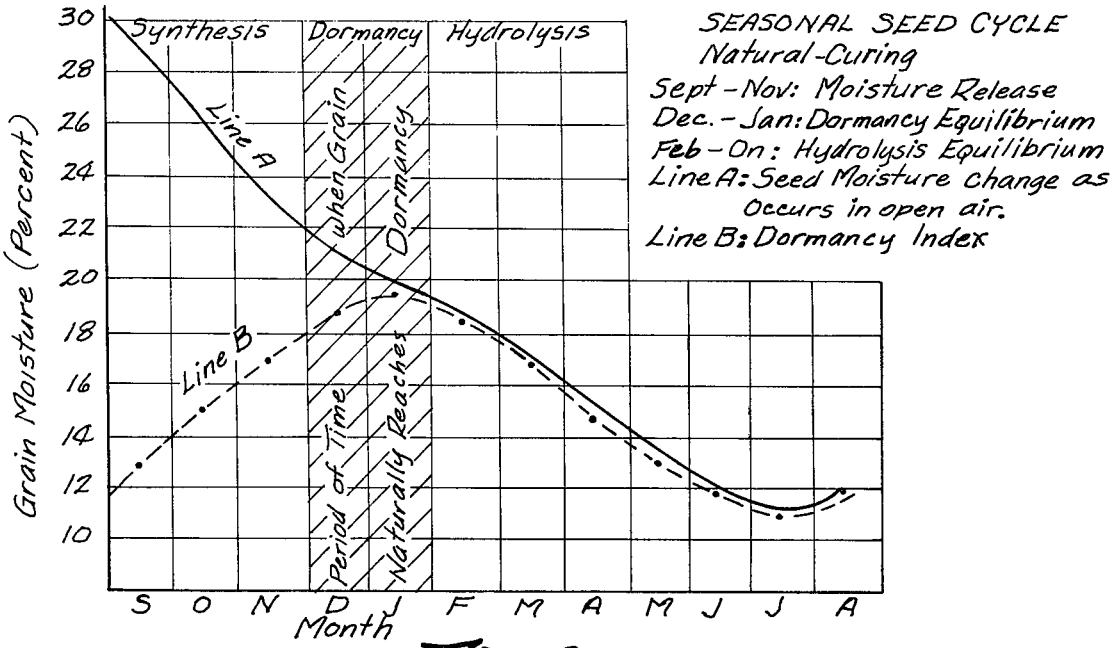
FIG. 8 is a chart showing the seasonal seed cycle having grain moisture plotted on a vertical axis and the month of the year plotted on a horizontal axis.

Referring now to FIG. 8, a graph is shown with grain moisture plotted on the vertical axis and the month of the year plotted on the horizontal axis. The horizontal axis refers to months of the year in the northern hemisphere. Further, FIG. 8 represents data for a specific grain; that is corn, and modificatons should be made when applying the process to other grains.

Line B of FIG. 8 is the grain dormancy index. The grain domancy index approximately represents the point where the grain temperature and moisture is in equilibrium with the monthly average atmospheric air temperature and moisture. Dormancy, of course, as a dynamic condition that changes from month to month.

The dormancy index represented by Line B was plotted using the following Mid-America monthly average atmospheric air temperatures and moistures:

TABLE 1

| Month | Average Air Temperature | Average Air Relative Humidity | Equilibrium Corn Moisture |
|---|---|---|---|
| September | 55° F. | 60% | 13.0% |
| October | 45° F. | 70% | 15.1% |
| November | 40° F. | 75% | 16.6% |
| December | 30° F. | 80% | 18.7% |
| January | 20° F. | 80% | 19.6% |
| February | 35° F. | 80% | 18.2% |
| March | 50° F. | 80% | 16.9 |
| April | 50° F. | 70% | 14.7% |
| May | 55° F. | 60% | 13.0% |
| June | 70° F. | 60% | 12.0% |
| July | 70° F. | 50% | 10.9% |
| August | 70° F. | 60% | 12.0% |

A similar dormancy index for other grains and/or for other geographical regions could easily be constructed from readily available data.

Dormancy represents a condition of restricted respiration. An examination of Line B of FIG. 8 shows that in the colder months a higher grain moisture can exist without stimulating respiration with the grain. A grain moisture higher than that which represents the dormant condition for a given month promotes respiration and results in consumption of the grain sugars causing a loss in grain weight. A grain moisture lower than that which represents the dormant condition for a given month inhibits the beneficial process of hydrolysis of the grain starches and protein. It is therefore desirable to control the grain storage environment to maintain the condition of dormancy so that respiration is minimized and hydrolysis is maximized. Line A of FIG. 8 represents the approximate grain moisture that results when grain is left to dry naturally in the open air. In co-pending U.S. patent application Ser. No. 422,760.

Steffen teaches a process for lowering grain moisture from that which exists at a time of harvest to that grain moisture which represents a condition of dormancy. Steffen refers to this drying process as the curing of grain. The curing period is represented by that portion of Line A from the point of beginning near the vertical axis to the point where Line A coincides with Line B, the dormancy index. The process of the instant invention is applicable to grain after it reaches dormancy.

Figure 9:
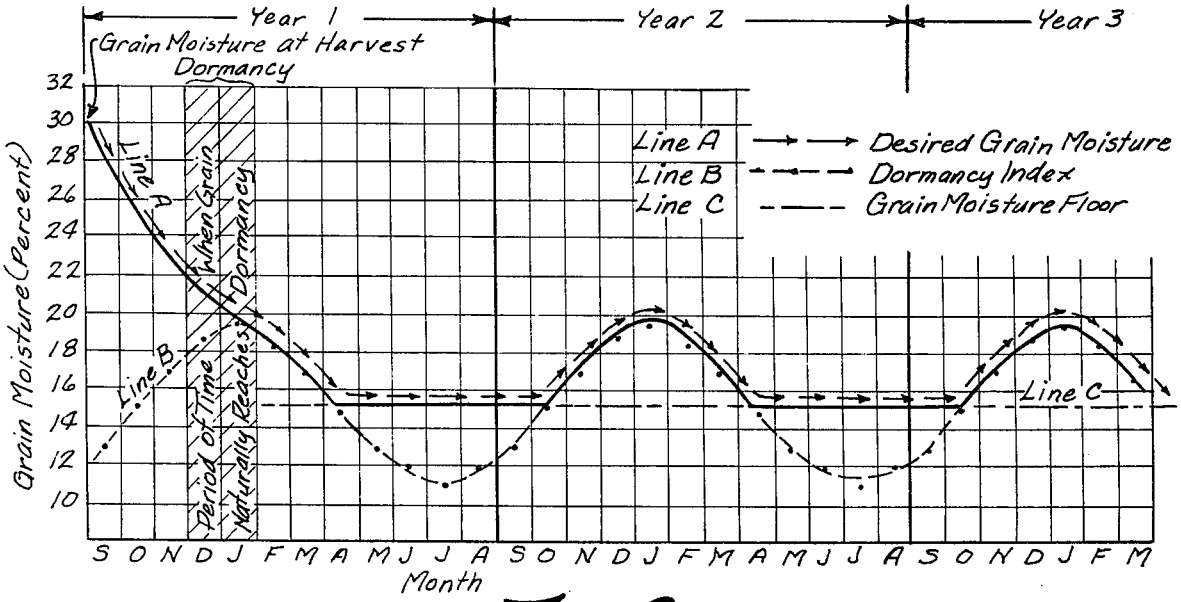
FIG. 9 is a graph similar to the graph of FIG. 8 but showing the process of the present invention over a period of years.

FIG. 9 is a graph similar to the graph shown in FIG. 8 and subject to the same modifications.

Line B of FIG. 9 is the grain dormancy index in a multi-year storage situation. Line B of FIG. 9 is plotted in the same manner as Line B of FIG. 8.

Line A of FIG. 9 represents the desired grain moisture that is achieved by practicing the process of this invention. FIG. 9 illustrates that the grain moisture represented by Line A is not allowed to fall below the grain moisture floor represented by Line C. The grain moisture floor can be set at any level within the moisture limits of the dormancy curve; that is, from approximately 20 percent grain moisture to approximately 11 percent grain moisture, when the grain is corn and the locality is Mid-America in the norther hemisphere.

When the grain moisture floor is set at approximately 11 percent, Line A will coincide with Line B, the dormancy curve. Referring to Table 1 above, it is apparent that the grain temperature would not be allowed to exceed approximately 70° Farenheit when the grain moisture floor is set at this level. Thus, for each grain moisture floor setting there will be a corresponding grain temperature ceiling. Temperatures above the grain temperature ceiling would provide conditions that encourage respiration within the grain and therefore are undesirable.

When the grain moisture floor is set at approximately 20 percent, Line A will coincide with Line C, the grain moisture floor. The grain temperature would not be allowed to exceed approximately 20° Fahrenheit when the grain moisture floor is set at this level. Again, each grain moisture floor setting results in a grain temperature ceiling above which respiration will be stimulated.

Line C in FIG. 9 has been set at approximately 15 percent grain moisture. The resultant grain temperature ceiling would therefore be approximately 50° Fahrenheit.

Line A in FIG. 9 illustrates that the process of this invention has two distinct phases; a dynamic phase, during which the grain moisture is manipulated so that it coincides with the dormancy index; and a static phase, during which the grain moisture is maintained at a level that coincides with the grain moisture floor. FIG. 9 further illustrates that the two phases complete a cycle which is repeated so long as the grain remains in storage.

The process of this invention will be in the dynamic phase when the grain moisture at dormancy for the current month is above the grain moisture floor. The dynamic phase will, therefore, generally be operative in the period from October to April when the grain moisture floor is set at 15 percent under the conditions represented on FIG. 9.

In the dynamic phase of the process of this invention, the stored grain is exposed to a throughput of atmospheric air so long as the atmospheric conditions are such that dormancy can be acheived; that is, so long as current atmospheric conditions are at or near the monthly average atmospheric conditions for the current month. In one embodiment of the present invention exposure of the grain to a throughout of atmospheric air is prevented when current atmospheric conditions are substantially different from the monthly average atmospheric conditions for the current month.

When grain is stored in a bin structure embodied in FIG. 1, exposure of the grain to a throughput of atmospheric air is accomplished by opening the damper 17 to allow the flow of atmospheric air through the intake duct 19 and into the intake plenum chamber 18; opening the movable cover 14; and activating the exhaust fan 16. Atmospheric air is thus drawn from the intake plenum chamber 18 through the air pervious grain floor 15, through the grain mass 25 stored in the grain storage chamber, through the exhaust plenum chamber 24, and exhausted into the atmosphere. The airflow requirements for this process in all embodiments thereof is at a very low level, from just above zero to one third CFM per bushel. Grain exposed to atmospheric air under these conditions is approximately maintained at a dormancy condition.

When current atmospheric conditions are such that the exposure of grain to a throughput of atmospheric air should be prevented, the exhaust fan 16 is deactivated, the movable cover 14 is closed, and the damper 17 is closed. It is noted that if the system is shut down that the door 14 should be opened from time to time and the fan 16 actuated to remove excess heat and moisture from the top plenum chamber 24 with the damper 17 closed.

Grain stored in a bin structure 30 embodied by FIG. 4 is exposed to a throughput of atmospheric air, i.e. ventilated, by opening the damper 17. When the damper is opened, the wind-powered turbine exhaust 21 draws atmospheric air through the system and exhausts it back into the atmosphere. When it is desired to prevent ventilation, the damper 17 is closed. Grain stored in this alternative bin structure embodiment, likewise, approximately maintains a dormancy condition in the grain and once the damper 17 is closed the turbine 21 still exhausts excess heat and moisture from the top plenum chamber 24 but does not draw air through the grain 25.

FIG. 3 represents a bin structure embodiment 20 wherein ventilation is accomplished by opening the damper 17 and activating an intake fan 22. The intake fan 22 forces atmospheric air through the system and it is then exhausted back into the atmosphere. Ventilation is prevented when desired by closing the damper 17 and deactivating the intake fan 22. Again, dormancy is maintained. This embodiment of FIG. 3 utilizing the intake fan 22 may be required in localities where prevailing surface winds are insufficient to induce an adequate draft utilizing the wind-powered exhaust turbine as illustrated in FIG. 4. Given a surface wind velocity of only 4 mph, however, a properly designed wind-powered turbine 21 can exhaust 3000 CFM. Such a wind-powered turbine used in conjunction with a 10,000 bushel storage bin would therefore provide an airflow of $\frac{1}{3}$ CFM per bushel of stored grain, an air flow sufficient to achieve continued dormancy in stored grain once it has initially achieved dormancy. It is important to note, for example, that the average annual wind velocity in Kansas is 14 mph. The average annual wind velocity in Iowa is 12 mph, excluding the months of July and August, months when the process of this invention would be in the static phase. Therefore the wind-powered turbine exhaust would generally produce an adequate draft to ventilate stored grain and accomplish the purposes of this phase of the process, that is to achieve dormancy in the stored grain.

The process of this invention will be in the static phase when the grain moisture at dormancy is at or below the grain moisture floor (Line C). Therefore, the static phase will generally be operative in the period from April to October, given a grain moisture floor setting of 15 percent.

During the static phase of this process, the stored grain will not be exposed to a throughput of atmospheric air, i.e. ventilated, so long as the ambient atmospheric air temperature is higher than the existing grain temperature. At a grain moisture of floor of 15 percent, for example, the corresponding grain temperature ceiling is 50° Fahrenheit. Therefore, the exising grain temperature would be 50° Fahrenheit or less. Ventilation will be accomplished in the same manner as that described for the static phase of this process when current atmospheric air temperatures are lower than the existing grain temperature in one embodiment of this invention.

Ventilation will generally be prevented during the static phase of this process because of the relatively high atmospheric air temperatures that prevail from April to October. In the absence of ventilation, heat and moisture of respiration will gradually accumulate in the atmosphere around the stored grain and will gradually reach a level wherein it will stimulate mold and bacterial infestation, resulting in spoilage. Periodic venting of the chamber 24 above the grain prevents this accumulation and stabilizes the grain environment so that hydrolysis can continue without creating conditions which promote respiration and external infestation.

When grain is stored in a bin structure embodied in FIG. 1, periodic venting of the grain air is accomplished by opening the movable cover 14 and activating the exhaust fan 16. The warm, moist air and the exhaust plenum chamber 24 is thus exhausted into the atmosphere and the heat and moisture of respiration is removed from the grain environment. When the venting of the grain air is completed, and the exhaust fan 16 is deactivated and the movable cover 14 is closed. The process of venting is repeated periodically.

FIGS. 3 and 4 represent bin structure embodiments wherein venting of the grain air is continually accomplished by the operation of the wind-powered turbine exhaust 21. The draft induced by the wind-powered turbine exhaust evacuates the heat and moisture of respiration from the exhaust plenum chamber 24 so long as surface winds are available to induce sufficient drafts. It is noted that because the damper 17 is closed, that air is not drawn through the grain at these times, but that only the exhaust plenum chamber 24 is vented.

In the static phase of the process of this invention, the insulative properties of the grain, the absence of ventilation with atmospheric air warmer than the grain, and the venting of the heat and moisture of respiration from the exhaust plenum chamber 24 allows the grain to maintain a temperature of approximately 50° Fahrenheit. During this period, the grain is therefore in a state of artificial dormancy wherein respiration is restricted and the process of hydrolysis is promoted due to the increased water available.

Obviously, many modifications and variations of the process of the present invention are possible in light of the above teachings. For example, it is apparent that air-cooling devices, bin insulation, and other means could additionally be used to maintain a low grain temperature. It is therefore to be understood that within the scope of the appended claims, the process of this invention may be practiced otherwise than as specifically described.

I claim:

1. A method for controlling the storage environment of cured grain wherein hydrolysis of the grain starches and protein is stimulated under conditions which restrict respiration of grain within a grain storage structure of a type including:

means for forming a grain storage chamber including a top and a bottom portion;

a perforated floor forming at least a part of the bottom portion of said grain storage chamber;

means attached to said perforated floor for forming a plenum chamber below said perforated floor;

an atmospheric air inlet opening disposed in said plenum chamber means;

damper means attached to said plenum chamber means for selectively opening or closing said inlet opening;

said top portion having an exhaust opening disposed therein;

exhaust means attached to said top portion for forcibly exhausting air from the top of said grain storage chamber; wherein said method comprises:

forcing atmospheric air to flow through the stored grain at substantially all times when the grain moisture at dormancy, for a given grain, locality and time, is above a predetermined grain moisture floor, with said damper means in an open position; and closing said damper means for substantially preventing the flow of outside air through the stored grain and simultaneously forcibly exhausting accumulated heat and moisture from said exhaust means by use of said exhaust means at substantially all times when the grain moisture at dormancy for a given grain, locality and time, is at or below said predetermined grain moisture floor.

2. A method for controlling the storage environment of cured grain wherein hydrolysis of the grain starches and protein is stimulated under conditions which restrict respiration of grain within a grain storage structure of a type including:

means for forming a grain storage chamber including a top and a bottom portion;

a perforated floor forming at least a part of the bottom portion of said grain storage chamber;

means attached to said perforated floor for forming a plenum chamber below said perforated floor;

an atmospheric air inlet opening diposed in said plenum chamber means;

damper means attached to said plenum chamber means for selectively opening or closing said inlet opening;

said top portion having an exhaust opening disposed therein;

exhaust means attached to said top portion for forcibly exhausting air from the top of said grain storage chamber; wherein said method comprises:

forcing atmospheric air to flow through the stored grain at substantially all times when the currently existing atmospheric air temperature is below a predetermined grain temperature ceiling, with said damper means in an open position; and closing said damper means for substantially preventing the flow of outside atmospheric air through the stored grain and simultaneously forcibly exhausting accumulated heat and moisture from said exhaust means by use of said exhaust means at substantially all times when the currently existing atmospheric air temperature is at or above the predetermined grain temperature ceiling.

3. A method for controlling the storage environment of cured grain wherein hydrolysis of the grain starches and protein is stimulated under conditions which restrict respiration of grain within a grain storage structure of a type including:

means for forming a grain storage chamber including a top and a bottom portion;

a perforated floor forming at least a part of the bottom portion of said grain storage chamber;

means attached to said perforated floor for forming a plenum chamber below said perforated floor;

an atmospheric air inlet opening disposed in said plenum chamber means;

damper means attached to said plenum chamber means for selectively opening or closing said inlet opening;

said top portion having an exhaust opening disposed therein;

exhaust means attached to said top portion for forcibly exhausting air from the top of said grain storage chamber; wherein said method comprises:

forcing atmospheric air to flow through the stored grain at substantially all times when the currently existing atmospheric air temperature is both below a predetermined grain temperature ceiling and below the grain temperature at dormancy, for a given grain and locality, for the current month, with said damper means in an open position; and closing said damper means for substantially preventing the flow of outside atmospheric air through the stored grain and simultaneously forcibly exhausting accumulated heat and moisture from said exhaust means by use of said exhaust means at substantially all times when the currently existing atmospheric temperature is either at or above a predetermined grain temperature ceiling, or at or above the grain temperature at dormancy, for a given grain and locality, for the current month.

* * * * *